US010553963B1

(12) United States Patent
Yi et al.

(10) Patent No.: US 10,553,963 B1
(45) Date of Patent: Feb. 4, 2020

(54) INSULATION CRIMP WITH LEAD-IN PROJECTION

(71) Applicant: TE CONNECTIVITY CORPORATION, Berwyn, PA (US)

(72) Inventors: Chong Hun Yi, Mechanicsburg, PA (US); Michael Christopher D'Imperio, Lancaster, PA (US); Stanrich Dwayne Fernandes, Harrisburg, PA (US); Rodney Thomas Smith, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/135,721

(22) Filed: Sep. 19, 2018

(51) Int. Cl.

| | |
|---|---|
| ***H01R 4/18*** | (2006.01) |
| ***H01R 43/048*** | (2006.01) |
| ***H01R 13/11*** | (2006.01) |
| ***H01R 4/62*** | (2006.01) |
| ***H01R 4/70*** | (2006.01) |
| ***H01R 43/058*** | (2006.01) |

(52) U.S. Cl.
CPC ..... *H01R 4/185* (2013.01); *H01R 4/62* (2013.01); *H01R 4/70* (2013.01); *H01R 13/11* (2013.01); *H01R 43/048* (2013.01); *H01R 43/058* (2013.01)

(58) Field of Classification Search
CPC . H01R 4/185; H01R 4/62; H01R 4/70; H01R 13/11; H01R 13/048
USPC ..... 439/877
See application file for complete search history.

(56) References Cited

U.S. PATENT DOCUMENTS

| | | | | |
|---|---|---|---|---|
| 2,854,648 | A * | 9/1958 | Berg | H01R 4/188 439/867 |
| 3,533,055 | A * | 10/1970 | Zak | H01R 4/188 174/84 C |
| 6,098,443 | A | 8/2000 | Muller et al. | |
| 6,206,727 | B1 * | 3/2001 | Aoyama | H01R 9/0518 439/424 |
| 6,558,208 | B2 * | 5/2003 | Suzuki | H01R 4/185 439/852 |
| 7,121,903 | B2 * | 10/2006 | Sakaguchi | H01R 4/185 439/877 |
| 7,419,411 | B2 * | 9/2008 | Kaneko | H01R 13/113 439/851 |

(Continued)

FOREIGN PATENT DOCUMENTS

DE 202007012609 U1 12/2007

*Primary Examiner* — Tulsidas C Patel
*Assistant Examiner* — Peter G Leigh

(57) ABSTRACT

An electrical contact includes a contact portion for mating with a mating contact, a wire barrel and an insulation barrel. The insulation barrel has a lead-in projection extending from the insulation barrel toward the wire barrel. The insulation barrel has a first crimping arm and a second crimping arm, with the first crimping arm positioned closer to the wire barrel than the second crimping arm. The lead-in projection is attached to and extends from the first crimping arm. The lead-in projection has a free end which extends proximate to the wire barrel and proximate to an electrical conductor of an electrical wire terminated in the wire barrel. The wire barrel is crimped to the electrical conductor of the electrical wire terminated in the wire barrel and the insulation barrel is crimped to an insulation sleeve of the electrical wire terminated in the wire barrel.

18 Claims, 3 Drawing Sheets

(56) References Cited

U.S. PATENT DOCUMENTS

| | | | | |
|---|---|---|---|---|
| 7,987,592 | B2 * | 8/2011 | Good | H01R 4/184<br>219/247 |
| 9,331,446 | B2 | 5/2016 | Bluemmel et al. | |
| 9,608,339 | B2 | 3/2017 | Ito | |
| 9,787,005 | B2 * | 10/2017 | Bluemmel | H01R 4/18 |
| 9,929,519 | B1 * | 3/2018 | Hall | H01R 13/405 |
| 2007/0264873 | A1 * | 11/2007 | Kakuta | H01R 4/185<br>439/585 |
| 2018/0062277 | A1 * | 3/2018 | Hamada | H01R 4/185 |

* cited by examiner

INSULATION CRIMP WITH LEAD-IN PROJECTION

FIELD OF THE INVENTION

The present invention is directed to an electrical contact with a lead-in projection extending from an insulation crimp. In particular, the invention is directed to a lead-in projection which extends from an insulation crimp to provide ease of assembly through a rear gang seal of an electrical connector.

BACKGROUND OF THE INVENTION

Electric connectors that prevent moisture from entering a housing of the electrical connector are commonly used in many industries. Generally, these sealed or waterproof connectors have a seal member formed of an elastomer arranged at a wire receiving opening of the housing where electric wires are connected to a contact or a fitting component of a mating connector. The seal member seals the entrance for the electric wires, which are connected to contacts inside the housing to prevent the influx of water therein. The seal member may either be an individual seal member where the seal member is individually attached to each of a plurality of the electric wires or a collective or gang seal member where the seal member is attached to the plurality of the electric wires as a group.

Regardless of the type of seal member, insertion of contacts and wires through the openings of the seal member may cause damage to the seal, thereby rendering the seal ineffective. This is of particular concern with large gauge wires, in which the diameter of the wires is significantly larger than the diameter of the openings, as the insulation sleeve or jacket of the wires engages or stubs against the seal during insertion, thereby preventing the proper insertion of the contact and wire in the connector housing. In addition, as the insulation sleeve or jacket and the insulation barrel have a sharp edge, the insertion of the insulation sleeve or jacket and the insulation barrel may damage the opening of the seal, rendering the seal ineffective.

It would, therefore, be beneficial to provide a contact with a lead-in projection extending from an insulation crimp to provide ease of assembly through a rear seal of the electrical connector and to prevent the insulation crimp or the wire from damaging the seal during insertion.

SUMMARY OF THE INVENTION

An embodiment is directed to an electrical contact having a contact portion for mating with a mating contact, a wire barrel and an insulation barrel. A lead-in projection extends from the insulation barrel toward the wire barrel. The lead-in projection has a sloped surface.

An embodiment is directed to an electrical contact having a contact portion, a wire barrel and an insulation barrel. The contact portion is configured to mate with a mating contact. The insulation barrel has a lead-in projection which extends from the insulation barrel toward the wire barrel. The insulation barrel has a first crimping arm and a second crimping arm, with the first crimping arm positioned closer to the wire barrel than the second crimping arm. The lead-in projection is attached to and extends from the first crimping arm. The lead-in projection has a curved surface.

An embodiment is directed to an electrical contact having a contact portion for mating with a mating contact, a wire barrel and an insulation barrel. The insulation barrel has a lead-in projection extending from the insulation barrel toward the wire barrel. The insulation barrel has a first crimping arm and a second crimping arm, with the first crimping arm positioned closer to the wire barrel than the second crimping arm. The lead-in projection is attached to and extends from the first crimping arm. The lead-in projection has a free end which extends proximate to the wire barrel and proximate to an electrical conductor of an electrical wire terminated in the wire barrel. The wire barrel is crimped to the electrical conductor of the electrical wire terminated in the wire barrel and the insulation barrel is crimped to an insulation sleeve of the electrical wire terminated in the wire barrel.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
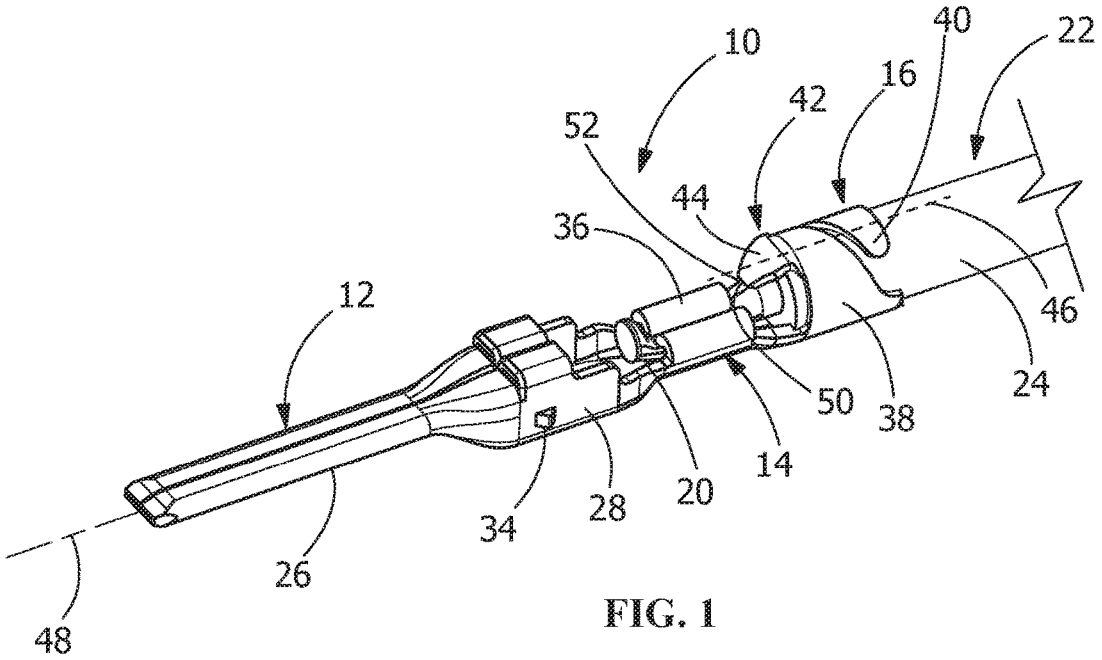
FIG. 1 is a perspective view of an illustrative electrical contact of the present invention terminated to a conductive wire, an insulation crimp portion of the electrical contact has a lead-in projection.
Figure 2:
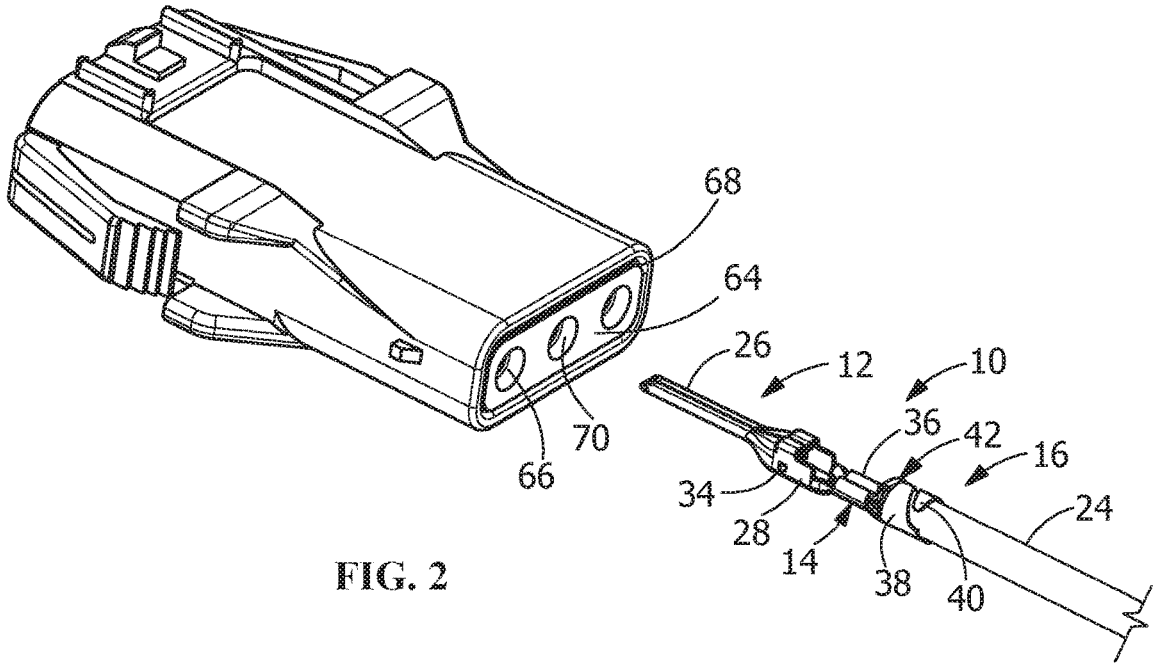
FIG. 2 is a perspective view of the electrical contact of FIG. 1 prior to insertion into a cavity of an illustrative electrical connector.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

As best shown in FIG. 1, a male contact 10 includes a contact portion 12 for mating with a mating connector (not shown), a wire barrel 14 behind the contact portion 12, and an insulation barrel 16 behind the wire barrel 14. The wire barrel 14 is configured for crimped connection with an end of an electrical conductor or conductive core 20 of an insulated electrical wire 22. The insulation barrel 16 is configured for crimped connection with an end of an insulation coating, sleeve or jacket 24 of the electrical wire 22.

Although a male contact is shown, the invention can be used with a female contact without departing from the scope of the invention. In the illustrative embodiment shown the terminal 10 is stamped and formed from a metal blank or plate having a good electrical conductivity. The contact 10 may be used for wires of different gauges, including, but not limited to, 14 and 16 gauge wires used for high current applications, such as 15 amps or more.

In the illustrative embodiment shown, the contact portion 12 includes a tab portion 26 and a mounting portion 28. While a tab portion 26 is shown, the tab portion may be replaced with socket or other configurations which are capable of mating with a mating contact. The mounting portion 28 is provided between the tab portion 26 and the wire barrel 14. The mounting portion 28 includes securing projections 34.

The wire barrel 14 has wire engaging walls 36 which cooperate with the electrical conductor or conductive core 20 of the insulated electrical wire 22 to maintain the electrical conductor or conductive core 20 of the insulated electrical wire 22 in position on the contact 10. In the embodiment shown, the wire engaging walls 36 are crimped to the wire 22. However, other termination methods may be used.

The insulation barrel 16 has a first insulation engaging or crimping arm 38 and a second insulation engaging or crimping arm 40 which cooperates with the sleeve or jacket 24 of the wire to maintain the sleeve or jacket 24 and the wire 22 in position on the contact 10. The first crimping arm 38 is positioned closer to the wire barrel than the second crimping arm 40. In the embodiment shown, the first insulation engaging arm 38 and the second insulation engaging arm 40 are crimped to the wire 22. However, other termination methods may be used.

A lead-in projection 42 is attached to and extends from the first crimping arm 38 of the insulation barrel 16. The lead-in projection 42 extends from the first crimping arm 38 of the insulation barrel 16 toward the wire barrel 14. The lead-in projection 42 has a sloped or arcuate surface 44. The longitudinal axis 46 of the lead-in projection 42 is provided in-line with the longitudinal axis 48 of the insulation barrel 16 and the electrical contact 10. A free end 50 of the lead-in projection 42 extends proximate to or in engagement the wire barrel 14 and proximate to the electrical conductor 20 of the electrical wire 22 terminated in the wire barrel 14. In the illustrative embodiment shown, the free end 50 of the lead-in projection 42 has an arcuate surface 52.

Referring to FIGS. 2 through 6, one or more contacts 10 are inserted into respective contact receiving cavities 60 of a connector housing 62. A seal 64 is provided at the end of each contact receiving cavity 60 to prevent moisture and debris from entering the cavity 60. In the illustrative embodiment shown, the seal 64 is a gang seal which extends across multiple contact receiving cavities 60. The seal 64 has openings 66 which align with the cavities 60 to allow the contact 10 to be inserted therethrough. In other embodiments, the seals 64 may be multiple individual seals which cooperate with a respective cavity 60. The seal(s) 64 are made from compliant material, such as, but not limited to, elastomer, which conforms to a seal receiving cavity 68 of the housing 62 and to the wires 22 which are inserted therethrough.

Figure 3:
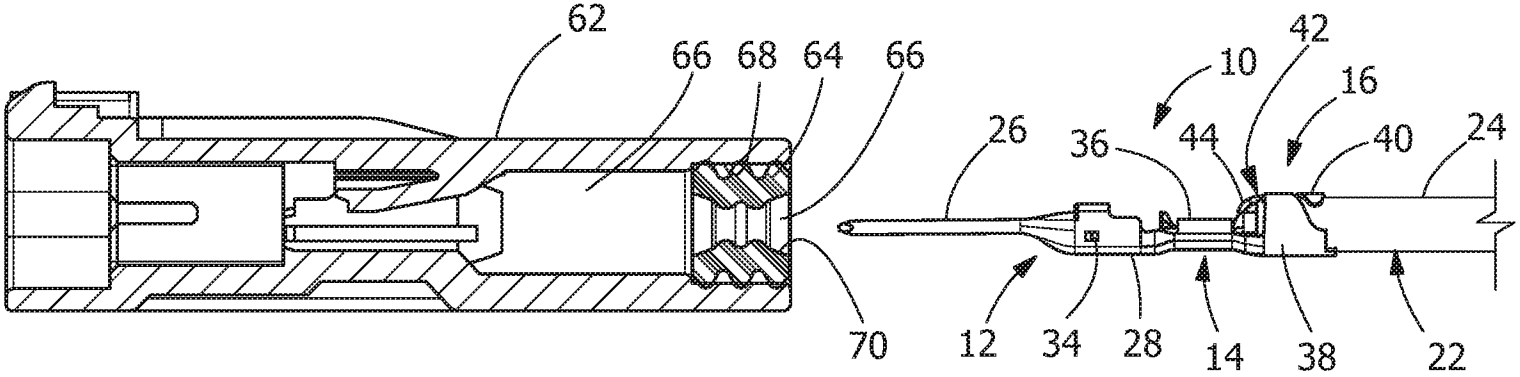
FIG. 3 is a cross-sectional view of the electrical connector of FIG. 2, taken along line 3-3 of FIG. 2.
Figure 4:
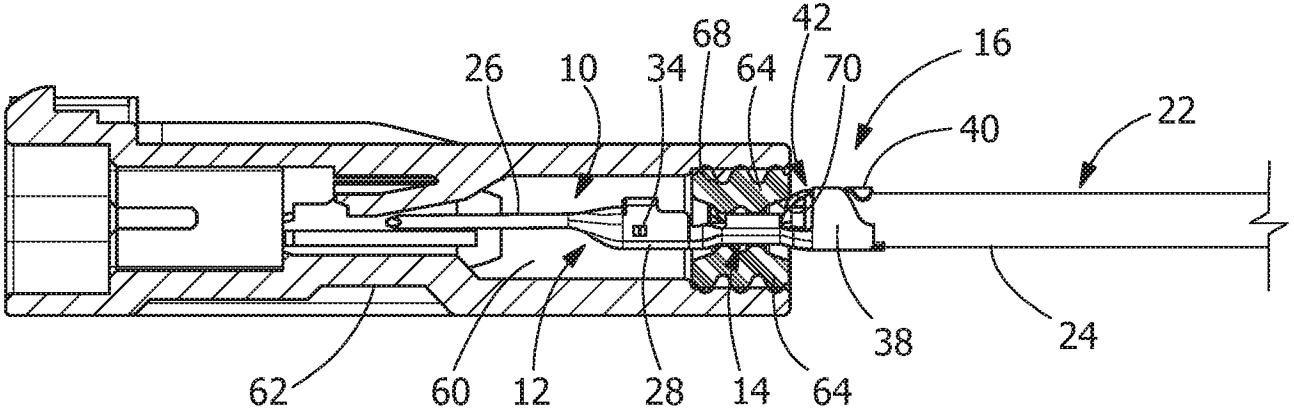
FIG. 4 is a cross-sectional view of the electrical connector similar to that shown in FIG. 3, with the electrical contact partially inserted into an opening of a seal of the electrical connector, the electrical contact is shown with the lead-in projection positioned outside of the cavity.

As the contact 10 and wire 22 are inserted into a respective contact receiving cavity 60 the contact 10 is moved from the position shown in FIG. 3 to the position shown in FIG. 4. As this occurs, the contact portion 12 and the wire barrel 14 are moved through the opening 66 of the seal 64. As the contact portion 12 and the wire barrel 14 have dimensions that are smaller or similar to the dimensions of the opening 66, the contact portion 12 and the wire barrel 14 are easily inserted into the cavity 60 through the opening 66 of the seal 64.

Figure 5:
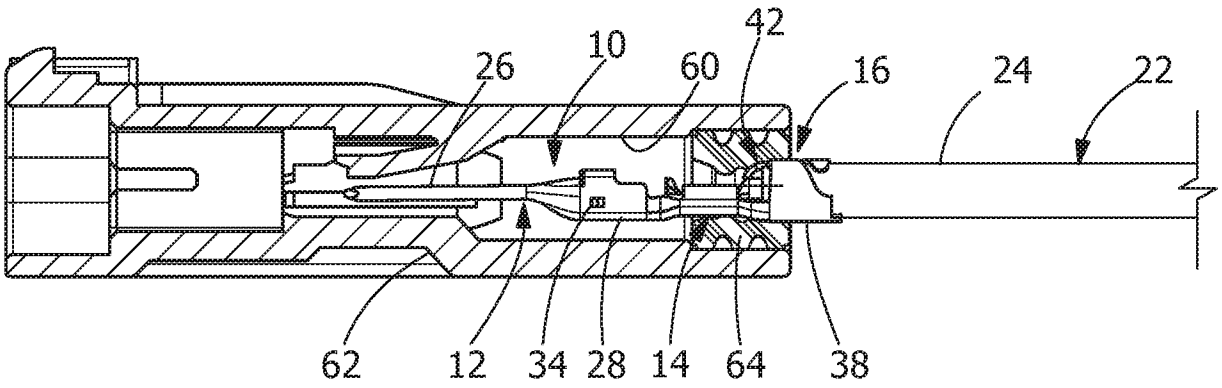
FIG. 5 is a cross-sectional view of the electrical connector similar to that shown in FIG. 3, with the electrical contact partially inserted into the opening of the seal of the, the electrical contact is shown with the lead-in projection inserted in the cavity of the seal of the electrical connector.
Figure 6:
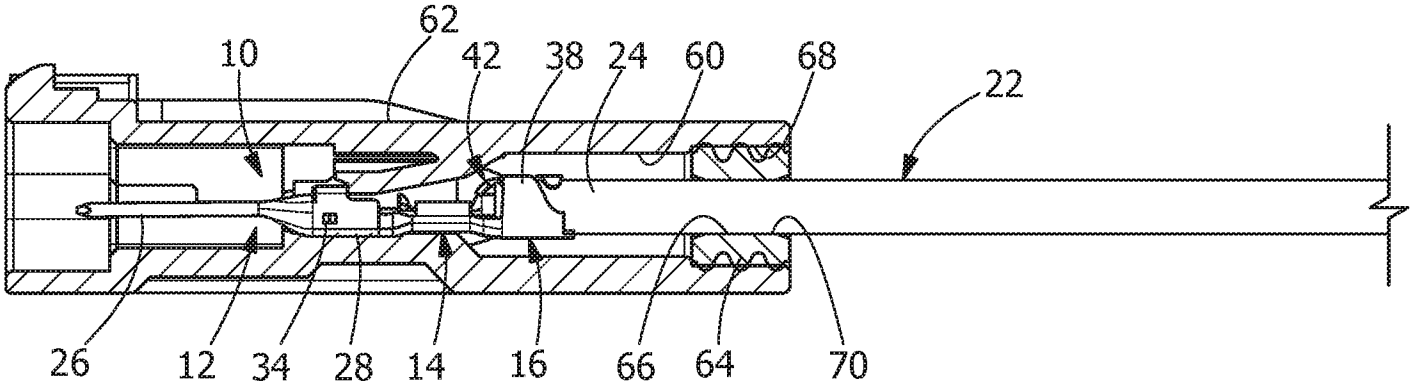
FIG. 6 a cross-sectional view of the electrical connector similar to that shown in FIG. 3 with the electrical contact fully inserted into the cavity of the electrical connector.

As insertion continues, the contact 10 and the insulation barrel 16 moves from the position shown in FIG. 4 to the position shown in FIG. 5. As this occurs, the lead-in projection 42 engages a sidewall 70 of the opening 66 of the seal 64, causing the sidewall 70 to deform in a controlled manner to allow the insulation barrel 16 and the wire 22 to be inserted into the opening 66 without damaging the opening 66, the sidewall 70 or the seal 64. As the free end 50 of the lead-in projection 42 extends proximate to or in engagement the wire barrel 14 and proximate to the electrical conductor 20 of the electrical wire 22, the free end 50 is positioned within the dimensions of the opening 66, allowing the free end 50 to enter the opening 50 with engaging or damaging the sidewall 70. As the lead-in projection 42 has a sloped or arcuate surface 44, the continued insertion of the lead-in projection 42 causes the sloped or arcuate surface 44 to engage the sidewall 70, causing the sidewall to expand or stretch in a controlled manner. As insertion continues, the sidewall 70 is expanded or stretched to allow the insertion of the wire therein, thereby allowing the contact 10 and wire 22 to be moved to the fully inserted position as shown in FIG. 6, in which the sidewall 70 of the opening 66 of the seal 64 conforms to the shape of the wire 22 to provide a proper and effective seal between the sidewall 70 of the opening 66 of the seal 64 and the wire 22.

The configuration of the lead-in projection 42 which is attached to and extends from the first crimping arm 38 of the insulation barrel 16 provides a smooth surface 44 which interacts with the sidewall 70 of the opening 66. In so doing, the sidewall 70 does not engage any sharp or harsh surfaces which would cause the sidewall 70 or seal 64 to be compromised or fail.

In contrast, with previously known contacts, as the insulation sleeve or jacket has a larger diameter than the diameter of the opening, the insertion of the wire into the opening has been difficult, as the insulation sleeve or jacket of previous wires would engage or stub against the seal, thereby preventing the proper insertion of the contact and wire in the connector housing. In addition, as the insulation sleeve or jacket and the insulation barrel of known contacts have a sharp edge, the insertion of the insulation sleeve or jacket and the insulation barrel could damage the opening of the seal, rendering the seal ineffective.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical contact comprising:

a contact portion for mating with a mating contact;

a wire barrel;

an insulation barrel having a lead-in projection extending from the insulation barrel toward the wire barrel, the lead-in projection having a sloped surface extending from a free end of the lead-in projection to the insulation barrel;

wherein the sloped surface engages a sidewall of a seal as the electrical contact is inserted into the seal.

2. The electrical contact as recited in claim 1, wherein the insulation barrel has a first crimping arm and a second crimping arm, the first crimping arm positioned closer to the wire barrel than the second crimping arm, the lead-in projection is attached to and extends from the first crimping arm.

3. The electrical contact as recited in claim 2, wherein a longitudinal axis of the lead-in projection is provided in-line with a longitudinal axis of the insulation barrel and the electrical contact.

4. The electrical contact as recited in claim 1, a free end of the lead-in projection extends proximate to the wire barrel and proximate to an electrical conductor of an electrical wire terminated in the wire barrel.

5. The electrical contact as recited in claim 4, wherein the wire barrel is crimped to the electrical conductor of the electrical wire terminated in the wire barrel and the insulation barrel is crimped to an insulation sleeve of the electrical wire terminated in the wire barrel.

6. The electrical contact as recited in claim 5, wherein the electrical wire is a 14-gauge wire or a 16-gauge wire.

7. The electrical contact as recited in claim 4, wherein the free end of the lead-in projection has an arcuate configuration.

8. The electrical contact as recited in claim 1, wherein the contact portion is a tab configured to mate with the mating contact.

9. An electrical contact comprising:

a contact portion for mating with a mating contact;

a wire barrel;

an insulation barrel having a lead-in projection extending from the insulation barrel toward the wire barrel, the insulation barrel having a first crimping arm and a second crimping arm, the first crimping arm positioned closer to the wire barrel than the second crimping arm, the lead-in projection being attached to and extending from the first crimping arm, the lead-in projection having a curved surface extending from a free end of the lead-in projection to the first crimping arm;

wherein the curved surface engages a sidewall of a seal as the electrical contact is inserted into the seal.

10. The electrical contact as recited in claim 9, wherein a longitudinal axis of the lead-in projection is provided in-line with a longitudinal axis of the insulation barrel and the electrical contact.

11. The electrical contact as recited in claim 10, a free end of the lead-in projection extends proximate to the wire barrel and proximate to an electrical conductor of an electrical wire terminated in the wire barrel.

12. The electrical contact as recited in claim 11, wherein the free end of the lead-in projection has an arcuate configuration.

13. The electrical contact as recited in claim 12, wherein the wire barrel is crimped to the electrical conductor of the electrical wire terminated in the wire barrel and the insulation barrel is crimped to an insulation sleeve of the electrical wire terminated in the wire barrel.

14. The electrical contact as recited in claim 13, wherein the electrical wire is a 14-gauge wire or a 16-gauge wire.

15. The electrical contact as recited in claim 12, wherein the contact portion is a tab configured to mate with the mating contact.

16. An electrical contact comprising:

a contact portion for mating with a mating contact;

a wire barrel;

an insulation barrel having a lead-in projection extending from the insulation barrel toward the wire barrel, the insulation barrel having a first crimping arm and a second crimping arm, the first crimping arm positioned closer to the wire barrel than the second crimping arm, the lead-in projection being attached to and extending from the first crimping arm;

the lead-in projection having a free end extending proximate to the wire barrel and proximate to an electrical conductor of an electrical wire terminated in the wire barrel, the lead-in projection having a slope surface extending from the free end of the lead-in projection to the insulation barrel;

wherein the wire barrel is crimped to the electrical conductor of the electrical wire terminated in the wire barrel and the insulation barrel is crimped to an insulation sleeve of the electrical wire terminated in the wire barrel;

wherein the sloped surface engages a sidewall of a seal as the electrical contact is inserted into the seal.

17. The electrical contact as recited in claim 16, wherein a longitudinal axis of the lead-in projection is provided in-line with a longitudinal axis of the insulation barrel and the electrical contact.

18. The electrical contact as recited in claim 16, wherein the free end of the lead-in projection has an arcuate configuration.

* * * * *